US006033626A

United States Patent [19]

Takahashi

[11] Patent Number: 6,033,626

[45] Date of Patent: Mar. 7, 2000

[54] HEAT-RESISTANT CAST STEEL HAVING HIGH RESISTANCE TO SURFACE SPALLING

[75] Inventor: Makoto Takahashi, Hirakata, Japan

[73] Assignee: Kubota Corporation, Osaka, Japan

[21] Appl. No.: 09/248,007

[22] Filed: Feb. 10, 1999

[30] Foreign Application Priority Data

Sep. 25, 1998 [JP] Japan ..... 10-270904

[51] Int. Cl.[7] ..... C22C 38/48; C22C 38/58; C22C 30/00

[52] U.S. Cl. ..... 420/48; 420/55; 420/584.1

[58] Field of Search ..... 420/55, 48, 584.1

[56] References Cited

FOREIGN PATENT DOCUMENTS 50-7532 3/1975 Japan ..... 420/584.1

54-58616 5/1979 Japan ..... 420/584.1

59-59865 4/1984 Japan ..... 420/584.1

*Primary Examiner*—Deborah Yee

*Attorney, Agent, or Firm*—Armstrong, Westerman, Hattori, McLeland & Naughton

[57] ABSTRACT

A heat-resistant cast steel excellent in resistance to surface spalling and in high-temperature strength, and useful, for example, as a material for forming the trunk portions of coiler drums for use in reversing hot rolling mills. The steel consists essentially of, in % by weight, 0.1 to 0.6% of C, over 0% to not more than 2% of Si, over 0% to not more than 4% of Mn, 24.5 to 32% of Cr, 13 to 25% of Ni, 0.5 to 2% of Nb and 0.1 to 0.25% of N, the balance being substantially Fe. When desired, the steel further comprises, in % by weight, at least one element selected from the group consisting of 0.02 to 0.2% of Al, 0.01 to 0.2% of Ti and 0.01 to 0.2% of Zr.

8 Claims, 3 Drawing Sheets

HEAT-RESISTANT CAST STEEL HAVING HIGH RESISTANCE TO SURFACE SPALLING

FIELD OF THE INVENTION

The present invention relates to heat-resistant cast steel which is excellent in resistance to surface spalling and in high-temperature strength and which is useful, for example, as a material for forming the trunk portions of coiler drums for use in reversing hot rolling mills.

BACKGROUND OF THE INVENTION

Reversing hot rolling mills which are called steckel mills are used as hot strip mills of relatively low equipment cost chiefly for hot-rolling slabs of stainless steel, special steel, etc.

With reference to FIG. 1 schematically showing the construction of the mill, temperature-holding furnaces 2, 2 arranged at opposite sides of a rolling stand 1 each have a coiler drum 3 in the interior thereof.

The holding furnace is maintained at a temperature, for example, of about 900 to about 1100° C. for holding the material to be rolled at a predetermined rolling temperature. The slab (about 100 to about 200 mm in thickness) is roughly rolled and thereafter processed to a thickness of about 15 mm to about 20 mm. The slab as roughly rolled is passed between rolling rolls 4, 4 of the steckel mill and rolled into a steel strip having a thickness of about 2 to about 10 mm while being alternately wound up on and unwound from the opposed coiler drums 3, 3 in repetition. Incidentally, the left coiler drum in the drawing rotates in a direction A (counterclockwise) when winding up the slab and in the opposite direction B (clockwise) when unwinding the slab, while the right coiler drum rotates in a direction A (clockwise) when winding up the slab and in the opposite direction B (counterclockwise) when unwinding the slab.

The coiler drum is a large hollow cylinder having an outside diameter of at least about 1000 mm, a length of about 2000 to about 3000 mm and a great wall thickness of more than about 50 mm. The drum is conventionally prepared from a 0.35C-24Cr-14Ni-1.4Nb—Fe heat-resistant alloy.

The coiler drum is not only exposed to a high temperature of about 900 to about 1100° C. but also brought into pressing contact over the surface of its trunk portion with an oxide film formed on the surface of the steel strip when winding up the steel strip. While winding up the steel strip repeatedly, therefore, the drum deteriorates over its surface to become rough-surfaced. If the drum is rough-surfaced, the surface spallation is transferred to the surface of the steel strip wound up on the drum, seriously degrading the surface of the steel strip as a product.

To give the coiler drum increased resistance to surface spallation is indispensable to the satisfactory surface quality of the steel strip and to improved durability and diminished maintenance of the drum.

Furthermore, the trunk portion of the coiler drum is repeatedly subjected to a great tightening force due to the winding of the steel strip in a high-temperature environment. Consequently, the coiler drum is susceptible to fatigue fracture due to deformation or hexagonal cracks, which produces an adverse influence on the durability of the drum or on the quality of the product, i.e., the steel strip.

In view of the above problems, the present invention provides a heat-resistant cast steel which is improved in resistance to surface spallation and in mechanical characteristics and which is useful, for example, as a material for forming coiler drums.

SUMMARY OF THE INVENTION

The present invention provides a heat-resistant cast steel comprising, in % by weight, 0.1 to 0.6% of C, over 0% to not more than 2% of Si, over 0% to not more than 4% of Mn, 24.5 to 32% of Cr, 13 to 25% of Ni, 0.5 to 2% of Nb and 0.1 to 0.25% of N, the balance being substantially Fe.

In addition to the above elements, at least one element selected from the group consisting of 0.02 to 0.2% of Al, 0.01 to 0.2% of Ti and 0.01 to 0.2% of Zr can be incorporated into the heat-resistant cast steel of the invention when so desired.

DETAILED DESCRIPTION OF THE INVENTION

Figure 1:
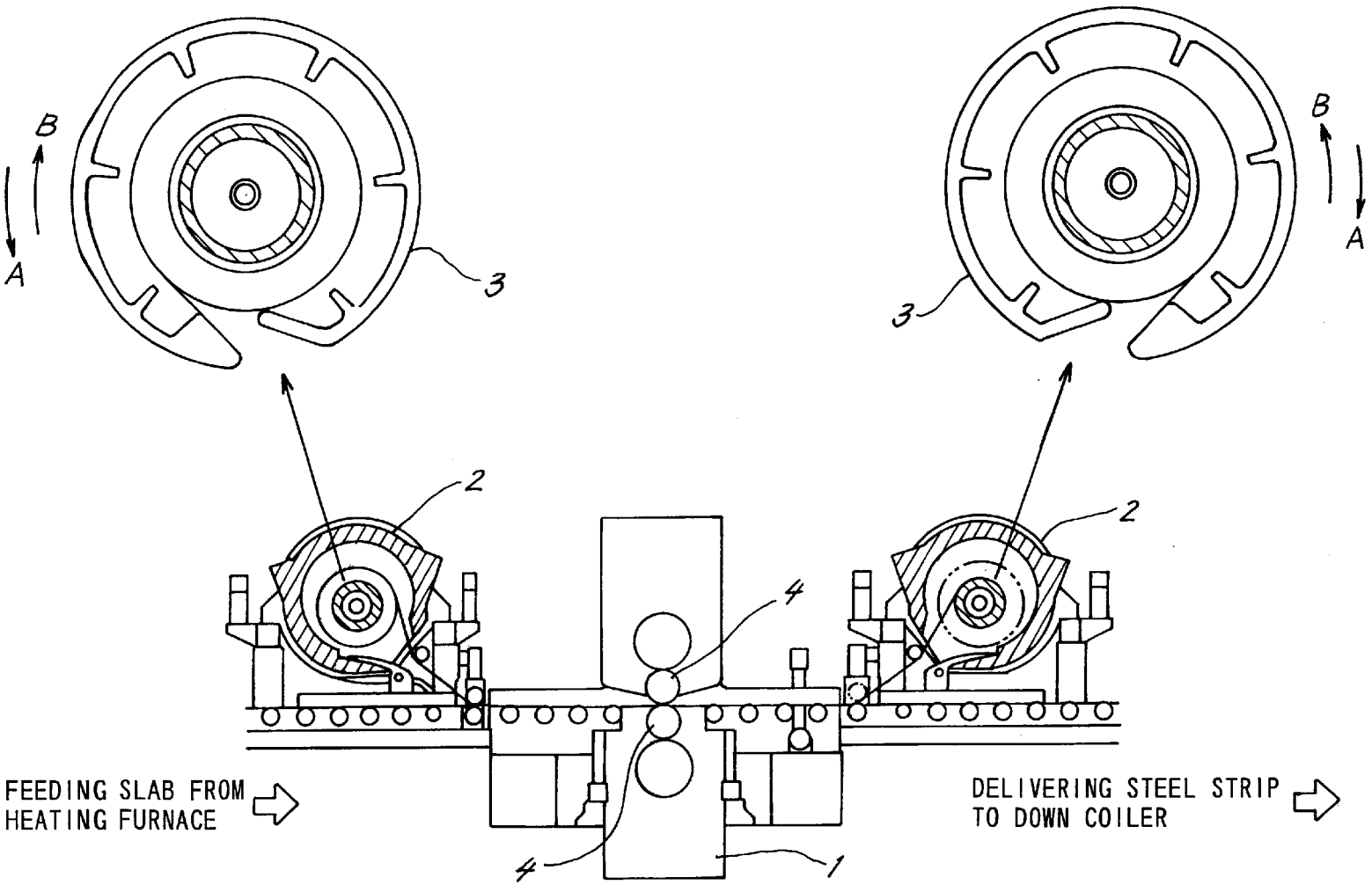
FIG. 1 is a diagram for schematically illustrating coiler drums in a reversing rolling mill.

The components of the heat-resistant cast steel of the invention are limited for the following reasons.

The percentages used herein to show the contents of the alloy elements are all by weight.

C: 0.1–0.6%

C combines with Nb and crystallizes out as NbC at the grain boundaries, giving an enhanced creep rupture strength at high temperatures, inhibiting the formation of secondary precipitates when the steel is used at high temperatures as an effect to reduce the C content of solid solution in the matrix, and diminishing or preventing a decrease in ductility after aging. It is desired that 0.1 to 0.6% of C be present to obtain the above effect of NbC for use at high temperatures of up to about 1100° C.

Si: over 0% to not more than 2%

Si is an element required for ensuring fluidity and deoxidation of steel during melting. However, an excess of Si added results in impaired weldability and a lower creep rupture strength, so that up to 2% of Si is used.

Mn: over 0% to not more than 4%

Mn deoxidizes molten steel and is effective for fixing S (forming MnS) and giving improved weldability. An increased amount of Mn further imparts improved tensile ductility at break to the steel as cast. However, the upper limit should be 4% since larger amounts lead to a lower creep rupture strength.

Cr: 24.5–32%

Cr is an element effective for giving higher resistance to oxidation, increased strength at high temperatures and enhanced resistance to surface spalling. At least 24.5% of Cr should be present to ensure the oxidation resistance and high-temperature strength required for use at 1000 to 1100° C. and to afford greatly improved resistance to surface spalling. Since the effect to suppress or prevent surface spalling improves with an increase in the amount of Cr, at least 27% of Cr is preferably present, whereas this entails a tendency toward lower tensile ductility, and more than 32% of Cr markedly shortens the creep rupture life. The upper limit is therefore 32%. The tensile ductility becomes somewhat sacrificed with an increase in the Cr content, but enhanced durability of the coiler drum and higher quality of the rolled material attained by the resulting improvement in surface spalling resistance more than offset the disadvantage of impaired tensile ductility.

Ni: 13–25%

Ni is an element required for stabilizing the oxidation resistance and structure of the steel. If the Ni content is less than 13%, embrittlement occurs on aging due to the precipitation of sigma phase at temperatures of about 900° C., whereas if the content is in excess of 25%, the material as cast exhibits lower tensile ductility at break at room temperature. The Ni content should therefore be 13 to 25%, preferably 15 to 20%.

Nb: 0.5–2%

Nb combines with C and crystallizes out as NbC, giving a higher creep rupture strength, and affording improved ductility on aging as an effect to reduce the solid solution C content. These effects are available when at least 0.5% of Nb is present. The preferred Nb content is at least 0.8%. The upper limit of the Nb content should be 2% since higher contents impair the ductility and creep rupture strength of the material as cast.

N: 0.1–0.25%

N dissolves in the austenitic matrix, effectively giving an enhanced tensile strength at high temperatures. N also stabilizes the austenitic phase. Presence of at least 0.1% of N produces these effects remarkably. However, the N content is limited to not greater than 0.25% since an excess of N results in a markedly impaired tensile elongation at break.

Al: 0.02–0.2%

Al is an element for giving increased resistance to oxidation. Preferably this element is added when so desired. At least 0.02% of Al should be present to obtain the effect. The Al content is limited to not higher than 0.2% since an increased amount of oxide then formed entails impaired tensile ductility.

Ti: 0.01–0.2%

Ti contributes to an improvement in creep rupture strength, so that this element is added preferably when so desired. At least 0.01% of Ti should be present to obtain the effect. The Ti content is limited to not higher than 0.2% since an increased amount of nitride then formed entails a lower creep rupture strength.

Zr: 0.01–0.2%

Like Ti, Zr contributes to an improvement in creep rupture strength, so that this element is added preferably when so desired. At least 0.01% of Zr is added to obtain the effect. The Zr content is limited to not higher than 0.2% since the presence of larger amount of Zr entails an impaired creep rupture strength due to an increase in the amount of nitride.

It is permissible that the heat-resistant steel of the present invention contain impurities which become incorporated therein inevitably when the steel is prepared by usual techniques involving melting. For example, presence of up to 0.04% of P and up to 0.04% of S will not impair the feature of the invention.

Members are produced from the heat-resistant cast steel of the invention by preparing a molten steel of specified composition and centrifugally casting the melt or pouring the melt into a mold. The cast body is usable as it is without necessitating any special refining heat treatment.

EXAMPLES

The chemical compositions of specimens are shown in Table 1, in which No. 1 to No. 7 are Invention Examples and No. 11 to No. 13 are Comparative Examples. No. 11 is typical of compositions of conventional materials. Although No. 12 and No. 13 are similar to Invention Examples in composition, the former is insufficient and the latter is excessive in Cr content.

The specimens shown in Table 1 were checked for tensile strength, 0.2% proof stress and elongation by tensile tests at room temperature and 1000° C.

Subsequently, a creep rupture test was conducted under the following conditions.

Test piece: diameter of parallel portion 8 mm gauge length 40 mm

Test temperature: 982° C.

Load: 3.5 kgf/mm$^2$ (JIS Z 2272)

The specimens were further tested for resistance to surface spalling by the following procedure.

Figure 2:
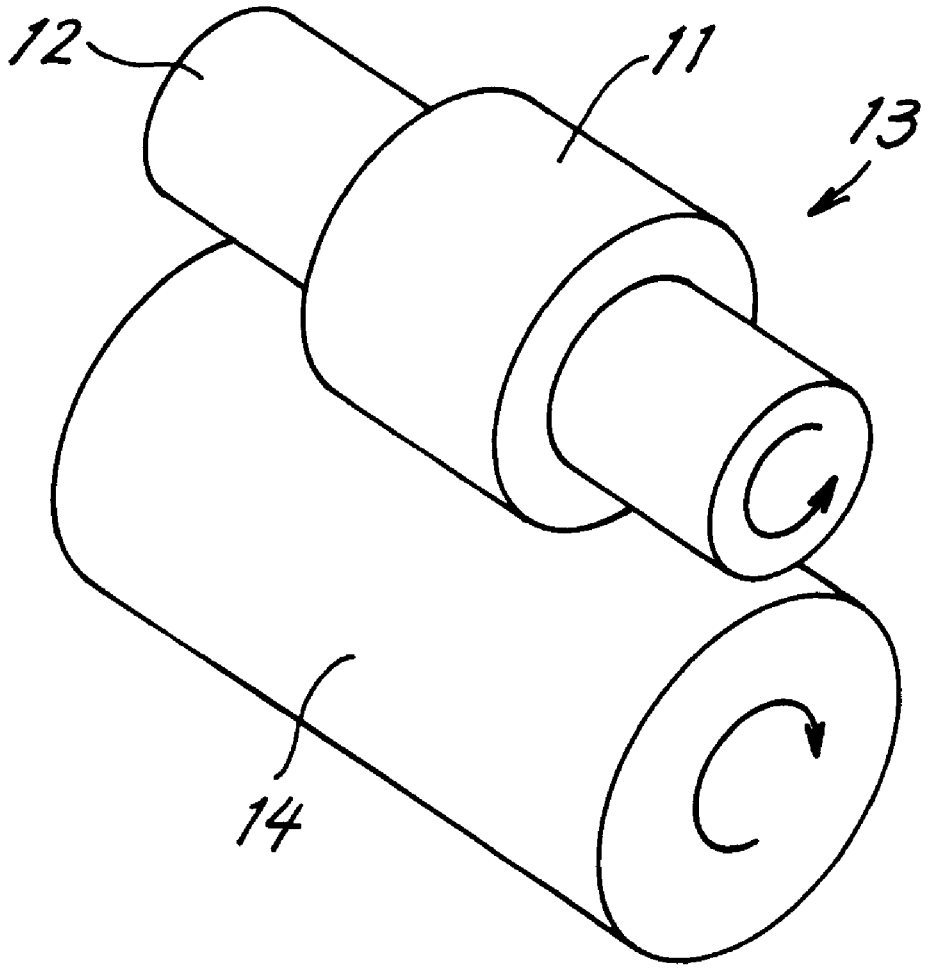
FIG. 2 is a diagram for illustrating the outline of a surface spalling resistance test.

A cast block of each specimen was machined to prepare a hollow cylinder 11, 60 mm in outside diameter, 40 mm in inside diameter and 30 mm in length. A shaft 12 was fittingly inserted through the cylinder 11 to obtain a roll 13, and a stainless steel round bar 14 (75 mm in outside diameter and 100 mm in length) separately prepared was disposed in parallel to the roll 13 in pressing contact with the roll surface as shown in FIG. 2.

The roll 13 was rotated, with the hollow cylinder 11 of the roll and the round bar 14 held heated. The surface of the stainless steel bar 14 was covered with an oxide film. The roll was held in rotation for a specified period of time, and the hollow cylinder 11 was thereafter checked for surface spalling with the unaided eye. The test temperature was 1000° C., the speed of rotation of the roll was 10 rpm, and the test time was 100 hours.

The results of the tensile tests, creep rupture test and surface spalling resistance test are shown in Table 2, in which the mark "○" in the column of "surface spalling resistance" indicates that the cylinder was free of surface spalling, and the mark "×" indicates that the cylinder was markedly rough-surfaced.

TABLE 1

| | Chemical Composition of Alloy (Balance Substantially Fe) by weight % | | | | | | | | | | | |
|---|---|---|---|---|---|---|---|---|---|---|---|---|
| No. | C | Si | Mn | P | S | Cr | Ni | Nb | N | Al | Ti | Zr |
| 1 | 0.30 | 0.85 | 2.37 | 0.017 | 0.012 | 27.14 | 17.0 | 1.44 | 0.144 | — | — | — |
| 2 | 0.34 | 0.94 | 2.41 | 0.017 | 0.011 | 28.44 | 16.5 | 1.40 | 0.149 | — | — | — |
| 3 | 0.32 | 0.88 | 2.55 | 0.016 | 0.012 | 30.26 | 16.9 | 1.36 | 0.153 | — | — | — |
| 4 | 0.32 | 0.91 | 2.39 | 0.016 | 0.011 | 31.91 | 17.4 | 1.47 | 0.146 | — | — | — |
| 5 | 0.32 | 0.86 | 2.36 | 0.018 | 0.011 | 28.25 | 17.7 | 1.41 | 0.148 | 0.13 | — | — |
| 6 | 0.33 | 0.89 | 2.45 | 0.017 | 0.012 | 28.16 | 17.4 | 1.43 | 0.144 | — | 0.15 | — |

TABLE 1-continued

| | Chemical Composition of Alloy (Balance Substantially Fe) by weight % | | | | | | | | | | | |
|---|---|---|---|---|---|---|---|---|---|---|---|---|
| No. | C | Si | Mn | P | S | Cr | Ni | Nb | N | Al | Ti | Zr |
| 7 | 0.33 | 0.90 | 2.38 | 0.017 | 0.012 | 28.34 | 17.5 | 1.38 | 0.141 | — | — | 0.10 |
| 11 | 0.32 | 0.66 | 0.82 | 0.018 | 0.010 | 23.90 | 13.5 | 1.38 | 0.043 | — | — | — |
| 12 | 0.32 | 0.83 | 2.39 | 0.016 | 0.013 | 24.37 | 16.4 | 1.45 | 0.144 | — | — | — |
| 13 | 0.33 | 0.89 | 2.47 | 0.017 | 0.013 | 33.70 | 16.2 | 1.46 | 0.156 | — | — | — |

TABLE 2

| | Tensile Test at Room Temperature | | | Tensile Test at High Temperature (1000° C.) | | | | |
|---|---|---|---|---|---|---|---|---|
| No. | Tensile Strength (MPa) | 0.2% Proof Stress (MPa) | Elongation (%) | Tensile Strength (MPa) | 0.2% Proof Stress (MPa) | longation (%) | Creep Rupture Time (Hrs) | Surface Roughness Resistance |
| 1 | 430 | 285 | 7.0 | 88.3 | 53.2 | 36.5 | 122 | ○ |
| 2 | 457 | 307 | 6.2 | 96.4 | 60.6 | 30.2 | 149 | ○ |
| 3 | 443 | 302 | 5.8 | 95.2 | 59.5 | 28.5 | 136 | ○ |
| 4 | 434 | 298 | 3.5 | 92.1 | 56.7 | 36.4 | 93 | ○ |
| 5 | 444 | 314 | 5.0 | 94.6 | 58.9 | 33.0 | 137 | ○ |
| 6 | 450 | 315 | 5.3 | 94.1 | 58.2 | 38.7 | 154 | ○ |
| 7 | 433 | 288 | 4.8 | 94.7 | 58.8 | 35.5 | 148 | ○ |
| 11 | 404 | 227 | 5.7 | 72.6 | 43.3 | 26.6 | 150 | X |
| 12 | 453 | 312 | 6.8 | 93.5 | 57.8 | 37.0 | 281 | X |
| 13 | 430 | 285 | 4.3 | 89.4 | 55.5 | 35.2 | 67 | ○ |

Invention Examples No. 1 to No. 7 are superior to the conventional material No. 11 in mechanical properties and surface spalling resistance at room temperature and high temperature. Comparative Example No. 12 is low in surface spalling resistance due to the insufficient Cr content. Although excellent in surface spalling resistance, Comparative Example No. 13 is seriously inferior in creep rupture life owing to the excessive Cr content.

Figure 3:
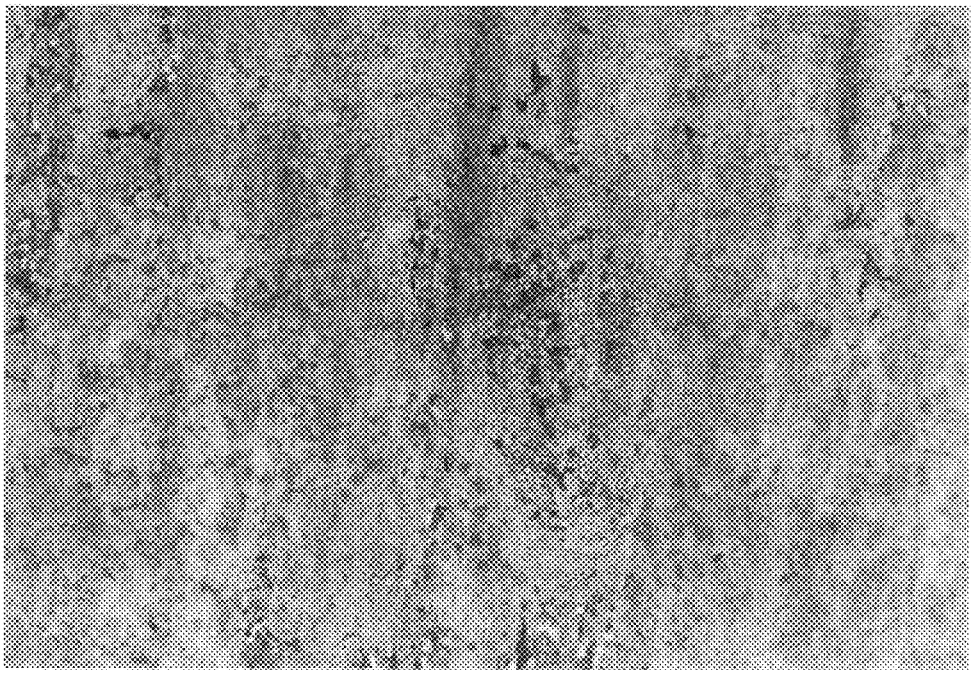
FIG. 3 is a photograph (magnification: ×5) showing the surface state of Invention Example No. 2 as tested for surface spalling resistance.
Figure 4:
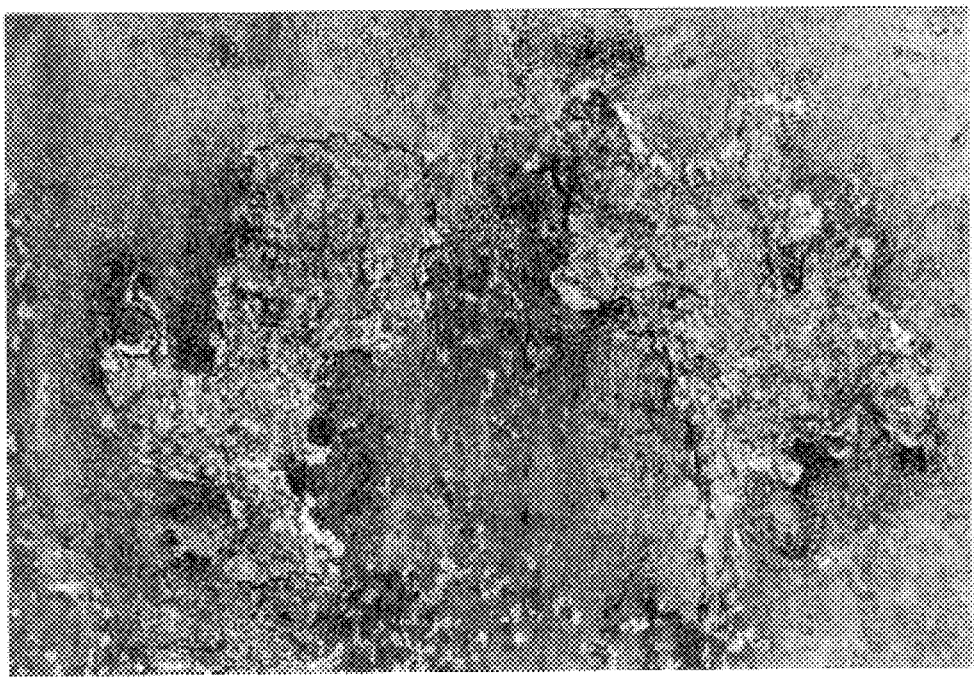
FIG. 4 is a photograph (magnification: ×5) showing the surface state of Comparative Example No. 12 as tested for surface spalling resistance.

FIGS. 3 and 4 show the surface states of the specimens of Invention Example No. 2 and Comparative Example No.12, respectively, as tested for surface spalling resistance.

The specimen of Invention Example No. 2 shown in FIG. 3 is free from any surface spalling, exhibiting a satisfactory smooth surface. In contrast, the specimen of Comparative Example No. 12 shown in FIG. 4 has a markedly deteriorated surface due to surface spalling.

The heat-resistant cast steel of the present invention is outstanding in resistance to surface spalling and mechanical properties for use in high-temperature environments, and is suited especially as a material for the coiler drums of reversing hot rolling mills, producing effects to give a prolonged service life, ensure diminished maintenance and provide steel strip products of improved and stabilized surface quality.

What is claimed is:

1. A heat-resistant cast alloy consisting essentially of, in % by weight, 0.1 to 0.6% of C, over 0% to not more than 2% of Si, over 2.36 to not more than 4% of Mn, 24.5 to 32% of Cr, 13 to 25% of Ni, 0.5 to 2% of Nb and 0.1 to 0.25% of N, the balance being substantially Fe.

2. The heat-resistant cast alloy according to claim 1 which includes 0.02 to 0.2% by weight of Al.

3. The heat-resistant cast alloy according to claim 1 which includes, in % by weight, 0.01 to 0.2% of Ti and/or 0.01 to 0.2% of Zr.

4. The heat-resistant cast alloy according to claim 2 which includes, in % by weight, 0.01 to 0.2% of Ti and/or 0.01 to 0.2% of Zr.

5. A coiler drum for use in a temperature-holding furnace to be disposed in the vicinity of a reversing hot rolling mill for alternately winding up or unwinding a material to be rolled, the drum being prepared from a heat-resistant cast alloy consisting essentially of, in percent by weight, 0.1 to 0.6% of C; over 0% to not more than 2% of Si; over 0% to not more than 4% of Mn; 24.5 to 32% of Cr; 13 to 25% of Ni; 0.5 to 2% of Nb and 0.1 to 0.25% of N, the balance being substantially Fe.

6. The coiler drum according to claim 5 wherein the heat-resistant cast alloy includes 0.02 to 0.2% by weight of Al.

7. The coiler drum according to claim 5 wherein the heat-resistant cast alloy includes, in % by weight, 0.01 to 0.2% of Ti and/or 0.01 to 0.2% of Zr.

8. The coiler drum according to claim 6 wherein the heat-resistant cast alloy includes, in % by weight, 0.01 to 0.2% of Ti and/or 0.01 to 0.2% of Zr.

* * * * *